US007592038B2

(12) United States Patent
Piton et al.

(10) Patent No.: US 7,592,038 B2
(45) Date of Patent: Sep. 22, 2009

(54) METHOD FOR REPAIRING SURFACE COATING DEFECTS

(75) Inventors: Mark C. Piton, Media, PA (US); James E. Fawcett, Hockessin, DE (US); Timothy Peoples, Jr., Detroit, MI (US); Anthony Kempski, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 25 days.

(21) Appl. No.: 11/703,908

(22) Filed: Feb. 8, 2007

(65) Prior Publication Data

US 2008/0003355 A1 Jan. 3, 2008

Related U.S. Application Data

(60) Provisional application No. 60/817,037, filed on Jun. 28, 2006.

(51) Int. Cl.
*B05D 3/00* (2006.01)

(52) U.S. Cl. ..... 427/140; 427/142; 427/402

(58) Field of Classification Search ..... 427/402, 427/124, 10, 140, 271, 275, 557, 559; 156/94, 156/98; 52/514, 14.5
See application file for complete search history.

(56) References Cited

U.S. PATENT DOCUMENTS

| | | | | |
|---|---|---|---|---|
| 6,332,291 | B1 | 12/2001 | Flosbach et al. | |
| 6,952,265 | B2 | 10/2005 | Prakash et al. | |
| 2004/0010091 | A1 | 1/2004 | Paquet, Jr. et al. | |
| 2005/0065291 | A1 * | 3/2005 | Swarup et al. | 525/419 |
| 2005/0128484 | A1 | 6/2005 | Rodrigues et al. | |
| 2005/0228124 | A1 * | 10/2005 | Swarup et al. | 524/800 |
| 2007/0104863 | A1 * | 5/2007 | Scholz et al. | 427/140 |

* cited by examiner

*Primary Examiner*—Michael Kornakov
*Assistant Examiner*—Xiao Zhao
(74) *Attorney, Agent, or Firm*—Gann G. Xu

(57) ABSTRACT

A method for repairing coating defects on a substrate with a surface coating with visual effects generated by the presence of visual effect pigments, said method comprising the steps of applying a first coating composition to form a first layer covering an affected area over the coating defect, wherein the first coating composition comprises one or more visual effect control agents and is free from said visual effect pigments; partially drying the first layer; applying a second coating composition over the first layer wherein the second coating composition comprises one or more visual effect control agents and one or more matching pigments for matching said visual effect of the surface coating; and d) curing said first and said second layers to form a repaired coating on said surface coating on said substrate; wherein said repaired coating is free of visible edge effects.

14 Claims, 3 Drawing Sheets

METHOD FOR REPAIRING SURFACE COATING DEFECTS

CROSS-REFERENCE TO RELATED APPLICATION

This application claims priority under 35 U.S.C. §119 from U.S. Provisional Application Ser. No. 60/817,037, filed Jun. 28, 2006.

FIELD OF INVENTION

This invention is directed to a method for repairing a coating defect of a substrate coated with a surface coating that exhibits a visual effect. This invention is further directed to a method for repairing a coating defect of an automobile coated with a metallic coating.

BACKGROUND OF INVENTION

The paint industry often utilizes light-reflecting flaked pigments in paints or coatings to obtain pleasing aesthetic effects. Coatings containing light-reflecting flaked pigment of such materials as aluminum, bronze, coated mica and the like are characterized by a "two-tone", "flip", "flip-flop" or "flop" effect, hereafter referred to as flop effects, whereby the apparent color of the paint changes at different viewing angles. Surface coatings containing a metallic flake pigment (i.e., metallic coatings), for example aluminum flake, are especially favored for the protection and decoration of automobile vehicle bodies for their visual effects, such as differential light reflection effect, exemplified by flop effects and flake appearance effects, as well as the enhancement of depth perception in the coating. The flop effects are due to the orientation of the flakes in the paint film. The degree of the flop effects achieved is a function of the orientation of the metallic flakes with respect to the surface plane of the coating. To attain a maximum flop effect, ideally, the flakes should all lie in planes parallel to the surface plane in a coating. However, in practice it is not possible to obtain more than a proportion of the flakes lying truly parallel, the remainder lies at various angles to the surface plane, i.e. there is a distribution of the orientations of the metallic flakes in the coating. The orientation of the flakes is also affected by a number of other factors, such as the presence of visual effect control agents, curing and drying speed of the coating or temperature of the surface at the time of coating application, etc.

When repairing a coating defect on a vehicle coated with a metallic coating, it is important that not only the color, but also the visual effect of the metallic coating is matched. A number of technologies have been developed to achieve the color and the visual effect match. U.S. Pat. No. 6,952,265 disclosed a method and a device for characterization and selection of metallic flakes to match the visual effect of a metallic coating. US Patent Publication No. 2005/0128484 disclosed a computer-implemented method for determining color match. It is known to the paint industry, especially automobile vehicle refinish industry, that a number of visual effect control agents, such as rheology control agents can be used in a metallic coating to control or modulate orientations of the metallic flakes with respect to the surface plane in the coating. Flop adjusters can also be used for controlling orientations of metallic flakes in a metallic coating. Some typical flop adjusters are glass beads or silica and titanium dioxide pigment. One of ordinary skill in the art, such as a paint technician can select a paint formulation that includes desired metallic flakes, rheology or any other visual effect control agents, and any additional additives to produce a repair paint that generally matches the color and the visual effect of a metallic original coating of the vehicle around the coating defect. The repair paint is then applied to a repair area covering the coating defect after certain surface preparations known to the coating and vehicle repair industry, such as but not limited to, cleaning, priming or sanding. In order to make the repair less distinguishable from the original vehicle coating around the repair area, a blending technique such as edge feathering is usually applied. Edge feathering produces gradually reduced paint thickness at the edge of the repair area so a smooth transition from the repair paint to the original coating is achieved. Feathering can be done by gradually moving a spray gun away from the vehicle surface while spraying. It can also be done by gradual reduction of spray pressure while spraying. A combination of moving the spray gun and reducing spray pressure can also be used.

Current problem for metallic coating repair is that the edge of the repair area shows slightly different visual effect. After drying, the edge of the repair area is visually noticeable producing an undesirable edge effect. This is mainly due to the fact that when thickness of the repair paint is reduced, orientations of the metallic flakes in the repair paint become randomized. Some attempts have been made by refinish industry to reduce the undesirable edge effect. One such attempt is to pre-wet the surface to be repaired with a layer of solvent or solvents and then apply the repair paint over the layer of solvents. However, pre-wet method failed to eliminate the undesirable edge effect.

It is therefore still in need for a method to repair metallic coating defects without undesirable edge effect.

STATEMENT OF INVENTION

This invention is directed to a method for repairing at least one coating defect disposed on a substrate coated with a surface coating that exhibits a visual effect generated by the presence of one or more visual effect pigments in said coating, said method comprising the steps of:

a) applying a first coating composition to form a first layer covering an affected area over the coating defect, wherein the first coating composition comprises one or more visual effect control agents;

b) partial drying the first layer;

c) applying a second coating composition over the partially dried first layer to form a second layer covering a repair area in that the repair area covers the coating defect and is nested within the affected area, wherein the second coating composition comprises one or more visual effect control agents and one or more matching pigments for matching said visual effect of the surface coating; and d) curing said first and said second layers to form a repaired coating on said surface coating on said substrate.

DETAILED DESCRIPTION OF PREFERRED THE EMBODIMENT

Figure 1A:
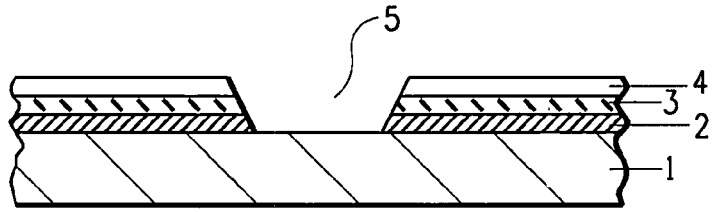
FIG. 1 shows a schematic presentation of cross sections of a coating defect at various stages of repair with conventional method: (A) the coating defect 5 disposed on a substrate 1 coated with multi-layer coatings including a primer layer 2, a metallic basecoat layer 3 and a clearcoat layer 4, before repair; (B) the coating defect filed with a repair primer 6; (C) the primer filled coating defect repaired with a matching metallic basecoat layer 7; and (D) schematic presentation of metallic flakes in randomized orientations in edge region 8.

The features and advantages of the present invention will be more readily understood, by those of ordinary skill in the art, from reading the following detailed description. It is to be appreciated that certain features of the invention, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

The use of numerical values in the various ranges specified in this application, unless expressly indicated otherwise, are stated as approximations as though the minimum and maximum values within the stated ranges were both proceeded by the word "about." In this manner, slight variations above and below the stated ranges can be used to achieve substantially the same results as values within the ranges. Also, the disclosure of these ranges is intended as a continuous range including every value between the minimum and maximum values.

As used herein:

"Coating composition" means a composition that can be used for surface coating. Typically, a coating composition can be a thermoset two-pack coating composition that comprises a crosslinking and a crosslinkable component, a radiation including ultraviolet (UV) curable coating composition, a moisture curable coating composition, or a heat curable coating composition. Typical crosslinking and crosslinkable components and coating compositions made thereof are described in US Patent Publication No. 2004/010091, Page. 2, Para. 26 and 27, Page 4, Para. 44-48, these paragraphs herein incorporated in by reference. Typical radiation curable coating compositions are described in U.S. Pat. No. 6,332,291, herein incorporated by reference. A coating composition can be solventborne or waterborne. A coating composition can be a primer, a basecoat, a clearcoat, or a top coat. A coating composition can be colored with dyes, pigments or a combination thereof. A coating composition can be used to coat a variety of substrates, such as, but not limited to, metal, plastic, wood, composite, or other natural or synthetic materials substrates. A coating composition can be used for coating surfaces of automobile vehicles, industrial equipments, buildings, air planes, water vessels, sports equipments, household appliances, or other tools and devices. Different coating compositions are well known in the coating industry.

"Two-pack coating composition" means a thermoset coating composition having two components stored in separate containers. The containers containing the two components are typically sealed to increase the shelf life of the components of the coating composition during storage. The components are mixed just prior to use to form a pot mix, which has a limited pot life, typically ranging from a few minutes (15 minutes to 45 minutes) to a few hours (4 hours to 8 hours). A pot life is a time period between the time when components of a coating composition are mixed to form a pot mix and to the time when the pot mix becomes too thick or too hard for practical application. A pot life of a specific coating composition is a characteristic of that coating composition and is typically determined empirically. The pot mix is then applied as a layer of a desired thickness on a substrate, such as an automobile body. After application, the layer dries and cures at ambient or at elevated temperatures to form a coating on the substrate having desired coating properties, such as, gloss, mar-resistance and resistance to environmental etching.

A "coated substrate" refers to a substrate covered with a coating, or multiple coatings. A coating or coatings can be a primer, a pigmented basecoat, a clear topcoat, or an un-colored clearcoat. The substrate can be covered by multiple layers of two different coatings, such as one or more layers of primers and one or more layers of pigmented basecoats as topcoats. The substrate can also be covered by multiple layers of at least three different coatings, such as one or more layers of primers, one or more layers of pigmented basecoats, and one or more layers of un-colored clearcoats. Examples of coated substrates can be a vehicle body or body parts coated with one or more monocolor paints, a vehicle body or body parts coated with one or more metallic paints, a bicycle body or body parts coated with one or more paints, a boat or boat parts coated with one or more paints, furniture or furniture parts coated with one or more paints, an airplane coated with one or more paints. The substrate can be made of metal, wood, plastic, fiberglass or other natural or synthetic materials.

"Solventborne" coating composition means a coating composition comprises one or more organic solvents as the major solvent.

"Waterborne" coating composition means a coating composition comprises water as the major solvent or dispersant.

"Coating defect" means a defect or damage on a surface coating of a coated substrate that are caused by mechanical, chemical actions or by atmospheric conditions. Such coating defects include paint chipping, cracks, scratches, small blemishes, discoloration, or other color or coating deterioration. A coating defect may affect one or more layers of the surface coating. In one embodiment, a coating defect only damages a clear top coat layer of the surface coating. In another embodiment, a coating defect damages multiple layers of the surface coating including clear top coat, basecoat and primer layers causing exposure of the substrate to the environment.

The term "refinished coating defect" refers to one or more repaired defects or damages on a surface coating of a coated substrate.

"Visual effect" refers to differential light reflection effect of a surface coating, such as "flop" or "flip-flop" effect, flake appearance effects, which include flake size distribution and the sparkle imparted by the flake, depth perception of the coating caused by the presence of flakes or pigment particles in the coating, and other color or light reflection or absorption effects noticeable by human eyes. Examples of visual effects include changing color or color tone or perception of depth of a metallic coating when viewed from different angles and lighting conditions. The term "visual effect" used herein specifically refers to differential light reflection effect of a surface coating caused by the presence of one or more visual effect pigments in the surface coating.

The term "pigment" or "pigments" used herein refers to a colorant or colorants that produce color or colors. A pigment can be from natural and synthetic sources and made of organic or inorganic constituents. A pigment also includes metallic particles or flakes with specific or mixed shapes and dimensions. A pigment is usually not soluble in a coating composition.

The term "dye" means a colorant or colorants that produce color or colors. Dye is usually soluble in a coating composition.

"Visual effect pigment" means a pigment that can cause differential light reflection effect of a surface coating when present in the surface coating. Examples of visual effect pigments include, but not limited to, light-reflecting flaked or particle pigment of such materials as aluminum, bronze, or coated mica.

"Matching pigment" refers to a visual effect pigment, when mixed into a matching coating composition, exhibits a visual effect matching an original visual effect produced by an original pigment mixed in an original coating composition.

"Visual effect control agent" refers to a group of materials that can control or modulate visual effects of a surface coating. Typical visual control agents include rheology control agents and/or sag control agents that modulate rheology and sag of a coating, such as silica; non-aqueous dispersions (NADs); treated clays; flow control additive, such as Disparlon ® LC-955 (Vinyl 2.2 polymer with silicone additive 10% solids in aromatic solvents from King Industries, Inc., Norwalk, Conn.); or "flop adjuster" that is an additive or additives in a metallic coating composition that disrupts the orientation of metallic flakes. Some typical flop adjusters are glass beads or silica and titanium dioxide pigment.

As used herein "vehicle" includes an automobile, such as car, bus, truck, semi truck, pickup truck, SUV (Sports Utility Vehicle); tractor; motorcycle; trailer; ATV (all terrain vehicle); heavy duty mover, such as, bulldozer, mobile crane and earth mover; airplanes; boats; ships; and other modes of transport that are coated with coating compositions.

Figure 1B:
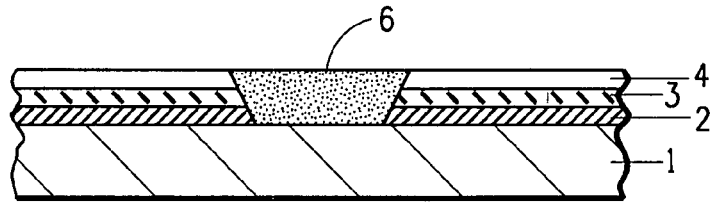
Figure 1C:
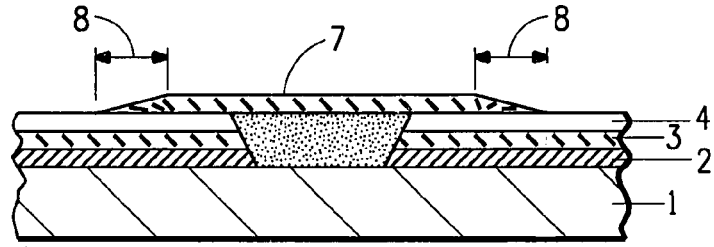
Figure 1D:
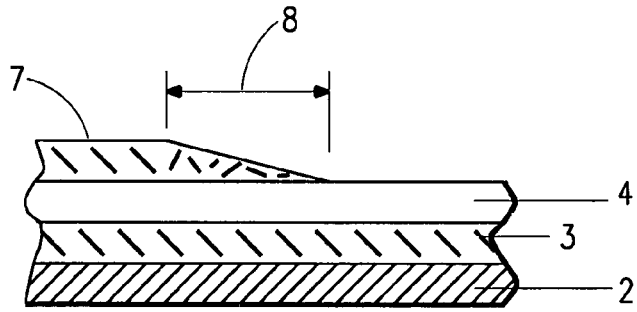
Figure 2A:
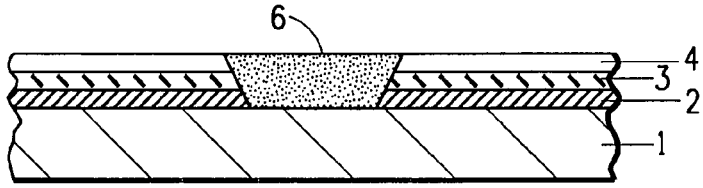
FIG. 2 shows a schematic presentation of cross sections of a coating defect at various stages of repair with present invention: (A) the coating defect filed with a repair primer 6; (B) the filled coating defect covered with a layer of un-pigmented basecoat layer 9; (C) a matching pigmented basecoat layer 10 applied over the un-pigmented basecoat layer 9; and (D) schematic presentation of metallic flakes in desired orientations in edge region 11.
Figure 2B:
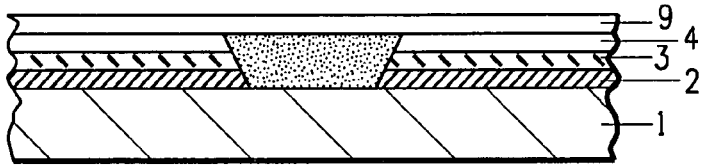
Figure 2C:
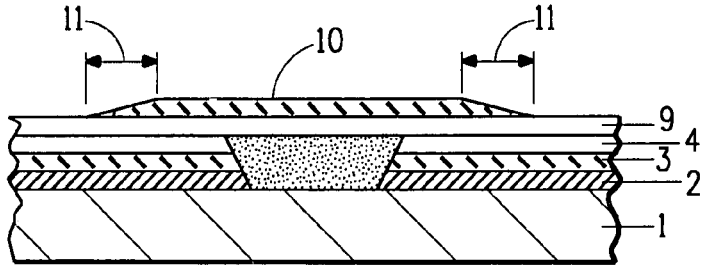
Figure 2D:
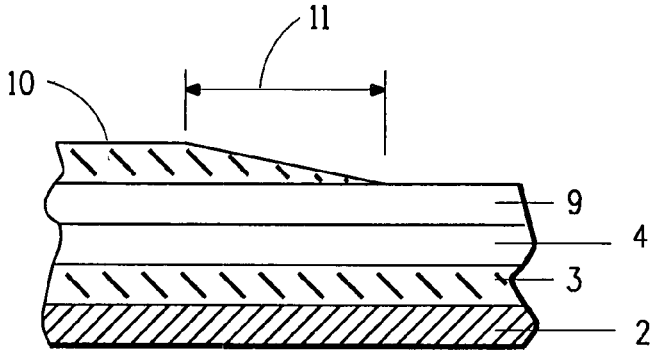
Figure 3:
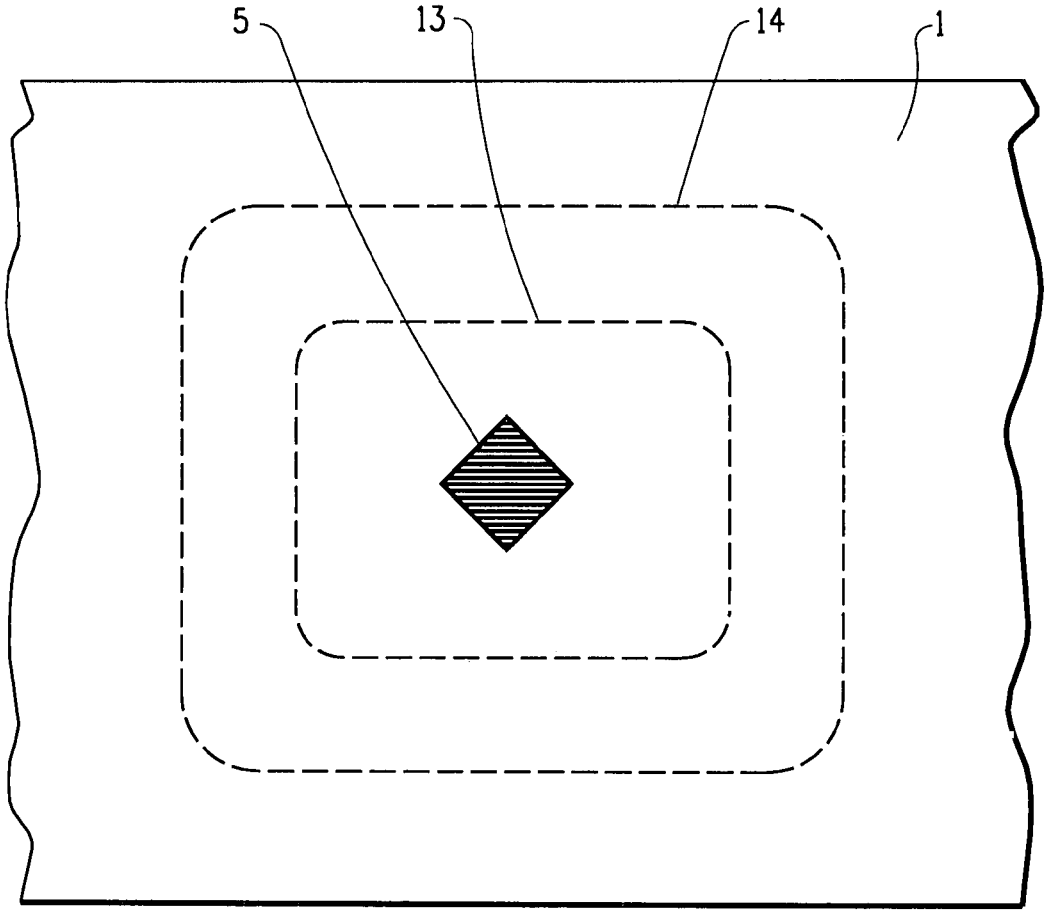
FIG. 3 shows a schematic presentation of a top-down view of the coating defect 5 disposed on the substrate 1, the repair area 13 and the affected area 14.

To repair a coating defect, the coating defect and an area around the defect are usually cleaned with conventional cleaning procedures known to one of ordinary skill in the art, such as, but mot limited to, washing with water and detergent, degreasing with an organic solvent or a solvent mixture, or any other cleaning procedure determined necessary by one of ordinary skill in the art. The coating defect may affect one or more layers of the surface coating. As illustrated in FIG. 1, a coating defect 5 is identified on a substrate 1 coated with a multi-layer original surface coating. The coating defect 5 damages multiple layers of the original surface coating including a primer layer 2, a metallic basecoat layer 3 and a clearcoat layer 4. The original surface coating has a color and exhibits flip-flop effect due the presence of pigments and visual effect pigment aluminum flakes in the metallic basecoat layer 3. Using methods described in aforementioned U.S. Pat. No. 6,952,265 and US Patent Publication No. 2005/0128484, a matching metallic basecoat formulation including the selection of matching pigments and visual effect control agents can be determined to produce a matching metallic basecoat that matches both color and visual effect of the original surface coating. A pot mix can be prepared to mix all ingredients according to the matching metallic basecoat formulation and the selected matching pigments.

The coating defect 5, after necessary cleaning procedure, is filled with a conventional repair primer 6. The repair primer 6 is then leveled with the area around the defect by conventional technique. The filled coating defect and the area around the defect may be sanded and further cleaned with conventional method known to one of ordinary skill in the art.

In a conventional repair process, the pot mix of the matching metallic basecoat is applied directly over a repair area 13 covering the coating defect 5 to form a matching metallic basecoat layer 7. The repair area 13 is usually larger than the size of the coating defect 5 to completely cover the defect 5. In order to make the repair less distinguishable from the original surface coating around the repair area, a blending technique such as edge feathering is usually applied. The blending technique is well known to one of ordinary skill in the art in coating repair industry. Edge feathering produces gradually reduced thickness of the matching metallic basecoat at the edge of the repair area so a smooth transition from the matching metallic basecoat to the original surface coating is achieved. Feathering can be done by gradually moving a spray gun that sprays the matching metallic basecoat away from the surface of the substrate while spraying. It can also be done by gradual reduction of spray pressure while spraying. One of ordinary skill in the art may choose or develop other blending techniques to achieve a smooth transition from the matching metallic basecoat to the original surface coating. The matching metallic basecoat layer 7 is then dried and cured. Using this conventional repair process, after drying, the edge of the repair area is visually noticeable producing an undesirable edge effect. This is mainly due to the fact that when thickness of the matching metallic basecoat is reduced, orientations of metallic flakes in the matching metallic basecoat become randomized.

Applicants of this invention discovered a novel method to eliminate the undesirable edge effect. A repair process of this invention can be described using the following embodiment.

In a repair process of this invention, two separate pot mixes are prepared after the coating defect is cleaned, filed with the primer and the matching metallic basecoat formulation is determined. A first pot mix contains all ingredients according to the matching metallic basecoat formulation except matching pigments. The first pot mix may contain optional pigments other than the matching pigments. A second pot mix contains all ingredients including the matching pigments according to the matching formulation. The first pot mix is applied to an affected area 14 over the coating defect 5 to form an un-pigmented basecoat layer 9. The affected area is usually larger than the size of the coating defect 5 to completely cover the defect and also provides sufficient space for next steps.

The un-pigmented basecoat layer 9 is then allowed to partial dry. The time period needed for partial drying, herein referred to as partial drying time is dependent on curing rate and evaporation rate profile of the un-pigmented basecoat. Curing rate is dependent on the chemical composition of a coating composition and is characteristic to that coating composition. An evaporation rate profile of the coating composition is an apparent evaporation rate of a mixture of multiple solvents and describes a time needed for solvents in said coating composition to evaporate after the coating composition is applied to a substrate. An evaporation rate profile can be determined experimentally or calculated from evaporation rates of individual solvents in that coating composition. Method for measuring evaporation rate of a solvent is known to the industry and can be found in Section 15.1.15 on page 1059 of "Handbook of Solvents", edited by G. Wypych, ChemTec Publishing, 2001. Briefly, the evaporation rate of a solvent is determined by comparing to a reference solvent, such as n-butyl acetate (nBuAc). The evaporation rate is the ratio of the time required for the evaporation of a solvent to be tested to the time required for the evaporation of the reference solvent under identical conditions. Evaporation rate of a solvent can also be determined according to ASTM D 3539 "Standard test for Evaporation Rates of Volatile Liquids by Shell Thin-Film Evaporometer" (ASTM International, 1987). An evaporation rate profile can be expressed as percentage of solvents evaporated at certain time points, such as 50% evaporation at 5 minute time point or 100% evaporation at 25 minute time point. The partial drying time can be in the range of from 10 percent to 90 percent, preferably in the range of from 20 percent to 80 percent, of the evaporation rate profile of the un-pigmented basecoat. In one embodiment, an un-pigmented basecoat has an evaporation rate profile of 100% evaporation at 10 minute time point. Partial drying time for this particular un-pigmented basecoat can be in a range from 1 to 9 minutes, preferably in a range from 2 to 8 minutes.

After partial drying the un-pigmented basecoat layer 9, the second pot mix is applied to a repair area 13 in that the repair area covers the coating defect and is nested within the affected area 14 to form a matching pigmented basecoat layer 10. Conventional blending techniques, such as edge feathering is employed. One of ordinary skill in the art may choose or develop different blending techniques to achieve a smooth transition from the matching metallic basecoat to the original surface coating without departing from the present invention. Due to the fact that the un-pigmented basecoat layer 9 contains necessary visual effect control agents and is only partially dry, the matching pigments in the matching pigmented basecoat layer 10 are settled down in desired orientations matching the visual effect of the original surface coating even in the feathering edge region 11. Both layers of the un-pigmented basecoat and the matching pigmented basecoat are cured and dried. After curing and drying, the edge of the repair area produced by the repair process of the present invention exhibits desired matching visual effect without the undesirable edge effect.

Optionally, drying times of the un-pigmented basecoat layer 9 and the matching pigmented basecoat layer 10 can be adjusted. A number of factors affect drying time of a coating layer, such as the temperature of the environment around the coating layer, the temperature of the substrate that the coating layer is applied to, thickness of the coating layer, atmosphere air pressure, air flow or ventilation around the coating layer, or solvent composition of the coating composition that produces the coating layer. Lower temperature, thicker layer, slower air flow or solvents with slower evaporation rates generally increases drying time of the coating layer. Higher temperature, thinner layer, faster air flow or solvents with faster evaporation rates generally reduces drying time of the coating layer.

It is known to the industry that solvents with different evaporation rates can be mixed to achieve an optimal drying time that is neither too slow nor too fast to allow a coating to flow and cure by crosslinking without affecting coating property. The apparent evaporation rate of a mixture of multiple solvents is often referred to as the evaporation rate profile of that mixture. Examples of solvents with faster evaporation rates (fast solvents) include acetone, ethanol, isopropanol, methyl ethyl ketone (MEK), and methyl isobutyl ketone (MIBK). Examples of solvents with slower evaporation rate (slow solvents) include glycol ethers, dibasic esters, and hi-boiling fractions of hydrocarbons. The terms "faster" and "slower" are based on comparison with a reference solvent, such as n-butyl acetate (nBuAc). One of ordinary skill in the art can adjust evaporation rate profile of a coating composition by adding more slow solvents or reducing the amount of fast solvents so the resulted coating layer can dry slower. One of ordinary skill in the art can also add more fast solvents or reducing the amount of slow solvents in a coating composition so the resulted coating layer can dry faster.

The un-pigmented basecoat layer 9 and the matching pigmented basecoat layer 10 can be dried and cured at room temperature or at elevated temperatures. Conventional method, such as, but not limited to, baking, using heating lamp or infrared radiation, or applying hot air flow can be used to achieve elevated temperatures. One of ordinary skill in the art can choose a suitable temperature or temperature range.

A layer of clearcoat can be applied over the matching pigmented basecoat layer 10 to proved additional protection, durability or other desired coating property such as high gloss. A number commercial available clearcoats, such as ChromaClear® 7900S or Imron® Elite 8840S, both from E.I. du Pont de Nemours and Company of Wilmington, Del., can be used. The clearcoat can be applied while the layers of the un-pigmented basecoat and the matching pigmented basecoat are still wet. It can also be applied after the layers are completely dried and cured. The layer of clearcoat can be dried and cured at room temperature or at elevated temperatures.

EXAMPLES

The present invention is further defined in the following Examples. It should be understood that these Examples, while indicating preferred embodiments of the invention, are given by way of illustration only. From the above discussion and these Examples, one skilled in the art can ascertain the essential characteristics of this invention, and without departing from the spirit and scope thereof, can make various changes and modifications of the invention to adapt it to various uses and conditions.

Procedure 1: Preparation of Un-pigmented Basecoat

Crosslinking component and crosslinker component for an un-pigmented basecoat were prepared according to Table 1. Immediately before spray application, the crosslinking component and the crosslinker component were mixed to form a ready-for-spray pot mix.

TABLE 1

| Item | Weight (grams) |
|---|---|
| Crosslinking Component: | |
| 1. Silica 8400E | 26.00 |
| 2. Acrylic Polyester PT197 | 26.00 |
| 3. Acrylic Polyester PT198 | 26.00 |
| 4. Ethyl Acetate | 16.90 |
| 5. Dibutyltin dilaurate (DBTDL) Tin catalyst | 0.05 |
| Crosslinkable Component: | |
| 6. Hexamethylene Diisocyanate (HDI) Trimer | 22.75 |
| 7. Ethyl Acetate | 12.25 |
| Total | 129.95 |

Note to Table 1:
Items 1, 2 and 3 are available from E. I. du Pont de Nemours and Company, Wilmington, Delaware, USA.
Item 5 is available as FasCat ® 4202 from Arkema Inc., Philadelphia, PA.
FasCat ® is a registered trademark of ARKEMA, INC. Philadelphia, PA.
Item 6 is available from Bayer Material Science LLC, Pittsburgh, Pennsylvania.

Procedure 2: Preparation of Un-pigmented Melamine Basecoat

Crosslinking component and crosslinker component for an un-pigmented melamine basecoat are prepared according to Table 2.

TABLE 2

| Item | Weight (grams) |
|---|---|
| Crosslinking Component: | |
| 1. Silica 8400E | 26.0 |
| 2. Acrylic Polyester PT197 | 26.0 |
| 3. Acrylic Polyester PT198 | 26.0 |
| 4. Ethyl Acetate | 16.9 |
| 5. Nacure ® 2500 Acid catalyst | 6.1 |
| 6. Resiflow ® S Flow Additive | 1.4 |
| 7. Cymel ® 1158 Melamine crosslinker | 18.9 |
| 8. Acetone Solvent | 25.0 |
| Total | 144.9 |

Note to Table 2:
Items 1, 2, and 3 are available from E. I. du Pont de Nemours and Company, Wilmington, Delaware, USA.
Item 5 is available from King Industries, Inc., Norwalk, CT 06852, USA. Nacure ® is a registered trademark of King Industries, Inc.
Item 6 is available from Estron Chemical, Inc., Parsippany, NJ. Resiflow ® is a registered trademark of Estron Chemical, Inc.
Item 7 is available from Cytec Industries Inc., West Paterson, New Jersey 07424, USA. Cymel ® is a registered trademark of Cytec Industries Inc.

Procedure 3: Preparation of Matching Pigmented Basecoat

Crosslinking component and Crosslinker component for matching pigmented basecoat were prepared according to Table 3. Immediately before spray application, 3 parts (based on volume) of the crosslinking component was mixed with 1 part (based on volume) of the crosslinker component to form a ready for spray pot mix.

This matching pigmented basecoat matches both color and visual effects of a silver metallic original surface coating.

TABLE 3

| Item | Weight (grams) |
|---|---|
| Crosslinking Component: | |
| 1. Silica 8400E | 128.9 |
| 2. Acrylic Polyester PT198 | 8.3 |
| 3. Acrylic Polyester PT197 | 158.9 |
| 4. Blue-Shade Green LS Tint PT133 | 0.3 |
| 5. Transparent Red Oxide Tint PT187 | 0.8 |
| 6. Black Tint LS PT107 | 9.3 |
| 7. Coarse Aluminum Tint PT114 | 100.3 |
| 8. Tin catalyst PT191 | 14.2 |
| 9. Solvent Mixture 8475S | 50.7 |
| Total | 471.7 |
| Crosslinker Component: | |
| 10. Isocyanate Activator 196S | |

Note to Table 3:
Items 1 through 10 are available from E. I. du Pont de Nemours and Company, Wilmington, Delaware, USA.

Examples 1 and 2

A scratch defect is disposed on a vehicle's front hood with a silver metallic original surface coating. The matching pigmented basecoat in Procedure 3 matches the color and visual effects of the silver metallic original surface coating of the vehicle. An affected area around the scratch is cleaned with water and detergent according to conventional method. A conventional primer is applied to fill the void space in the scratch. After the primer is dried, the filled scratch is lightly sanded to form a filled scratch leveled with the original surface coating. The un-pigmented basecoat prepared in Procedure 1 or Procedure 2 is spray applied to the affected area covering the scratch to form an un-pigmented basecoat layer.

The un-pigmented basecoat layer is allowed to partial dry for about 3 minutes. The matching pigmented basecoat prepared in Procedure 3 is spray applied over the partially dried un-pigmented basecoat layer. Conventional blending technique is employed to feather out the matching pigmented basecoat to form a repair area. The repair area is nested within the affected area covered with the un-pigmented basecoat.

The un-pigmented and the matching pigmented basecoat layers are then dried and cured at room temperature for about 30 minutes.

Example 3

A standard 18"×36" aluminum panel, part number APR-26595 (18"×36"×0.25") available from ACT Laboratories of Hillsdale, Mich., was first sanded with a sandpaper and then coated with a commercial refinish paint system including a silver metallic Imron® Elite basecoat and Imron® Elite 8840S clearcoat, both from E.I. du Pont de Nemours and Company of Wilmington, Del., per manufacturer's instructions. The coated panel was dried and cured for at least 30 minutes at room temperature. The matching pigmented basecoat described in Procedure 3 matches the color and visual effects of the silver metallic original surface coating of the panel. One small area of the coated panel was sanded to create a coating defect that damaged the layers of the clearcoat and the silver metallic basecoat.

The coating defect on the panel was filled in with a conventional primer. After the primer was dried, the filled coating defect was lightly sanded. The un-pigmented basecoat prepared in Procedure 1 was spray applied to the affected area covering the coating defect to form an un-pigmented basecoat layer.

The un-pigmented basecoat layer was allowed to partial dry for about 3 minutes. The matching pigmented basecoat prepared in Procedure 3 was spray applied over the partially dried un-pigmented basecoat layer. Conventional blending technique was employed to feather out the matching pigmented basecoat to form a repair area. The repair area was over the coating defect and nested within the affected area covered with the un-pigmented basecoat.

The un-pigmented and the matching pigmented basecoat layers were then dried and cured at room temperature for about 30 minutes.

A clearcoat Imron® Elite 8420S from E.I. du Pont de Nemours and Company of Wilmington, Del., was then spray applied over the affected area according the manufacturer's instructions to provide additional durability and appearance. The entire panel was air dried at room temperature for about 30 minutes.

Optionally, the panel can be baked at 40 to 60° C. (104 to 140° F.) for 20 to 30 minutes.

What is claimed is

1. A method for repairing at least one coating defect disposed on a substrate coated with a surface coating that exhibits a visual effect generated by the presence of one or more visual effect pigments in said surface coating, said method comprising the steps of:

a) applying a first coating composition to form a first layer covering an affected area over the coating defect, wherein the first coating composition comprises one or more visual effect control agents and is free from said visual effect pigments;

b) partial drying the first layer;

c) applying a second coating composition over the partially dried first layer to form a second layer covering a repair area in that the repair area covers the coating defect and is nested within the affected area, wherein the second coating composition comprises one or more visual effect control agents and one or more matching pigments for matching said visual effect of the surface coating; and d) curing said first and said second layers to form a repaired coating on said surface coating on said substrate;

wherein said repaired coating is free of visible edge effect and has visual effect that matches the visual effect of said surface coating.

2. The method of claim 1 further comprising the step of applying a layer of clearcoat over said repaired coating.

3. The method of claim 1, wherein the visual effect control agent is selected from rheology control agent, sag control agent, flop adjuster, flow control additive, or a combination thereof.

4. The method of claim 1, wherein the visual effect control agent comprises silica.

5. The method of claim 1, wherein the visual effect pigments are selected from aluminum flakes, bronze flakes, coated mica particles, or a combination thereof.

6. The method of claim 1, wherein the matching pigments are selected from aluminum flakes, bronze flakes, coated mica particles, or a combination thereof.

7. The method of claim 1, wherein the first coating composition is a basecoat composition.

8. The method of claim 1, wherein the second coating composition is a pigmented metallic basecoat composition.

9. The method of claim 1, wherein the first or the second coating composition comprises a crosslinking component and a crosslinkable component.

10. The method of claim 1, wherein the first or the second coating composition is a solvent borne coating composition.

11. The method of claim 1, wherein the first or the second coating composition is a waterborne coating composition.

12. The method of claim 1, wherein the first or the second coating composition is a radiation curable coating composition.

13. The method of claim 1, wherein the substrate is a vehicle body or a vehicle body part.

14. The method of claim 1, wherein the first coating composition further comprises optional pigment or pigments.

* * * * *